US005416960A

United States Patent [19]

Kroyer

[11] Patent Number: 5,416,960

[45] Date of Patent: May 23, 1995

[54] METHOD FOR THE PRODUCTION OF FIBROUS MATERIAL CONTAINING CURLED FIBERS

[76] Inventor: Karl K. K. Kroyer, Le Vieux Moulin, 12, rue de la Libération, F-06520 Magagnosc, France

[21] Appl. No.: 141,933

[22] Filed: Oct. 28, 1993

[51] Int. Cl.[6] ..... D06M 10/00; D21B 1/04; B02C 4/20; B29D 7/00

[52] U.S. Cl. ..... 28/165; 19/66.1; 162/146; 241/189.1; 264/118; 425/83.1

[58] Field of Search ..... 28/165, 166, 170, 171; 26/22, 25; 19/66.1, 66.2, 88, 89, 95–96, 303, 305; 241/58, 186.35, 190, 291, 292.1; 425/80.1, 83.1

[56] References Cited

U.S. PATENT DOCUMENTS

| | | | |
|---|---|---|---|
| 1,742,129 | 12/1929 | Brennen | 19/94 |
| 1,749,954 | 3/1930 | Luebbers | 241/190 X |
| 2,635,298 | 4/1953 | Lepkowski | 19/95 |
| 2,809,400 | 10/1957 | Maltenfort | 19/95 X |
| 2,863,176 | 12/1958 | Labino | 28/166 X |
| 2,940,133 | 6/1960 | Heritage | 425/83.1 X |
| 3,473,206 | 10/1969 | Boultinghouse | 19/66.1 |
| 3,759,775 | 9/1973 | Shepard | 28/165 |
| 3,984,898 | 10/1976 | Matsumura et al. | 19/94 X |
| 4,014,648 | 3/1977 | Walsh et al. | 28/166 X |
| 4,176,527 | 12/1979 | Lingstromberg et al. | 241/190 X |
| 5,064,689 | 11/1991 | Young, Sr. et al. | 425/83.1 X |
| 5,108,678 | 4/1992 | Hirasaka et al. | 19/305 |
| 5,167,765 | 12/1992 | Nielsen et al. | 162/146 |
| 5,316,601 | 5/1994 | Hebbard et al. | 264/116 X |

*Primary Examiner*—Clifford D. Crowder
*Assistant Examiner*—Ismael Izaguirre
*Attorney, Agent, or Firm*—Watson, Cole, Grindle & Watson

[57] ABSTRACT

A method for the production of a fibrous product containing curled fibers includes applying rectilinear bi-component fibers (17) to the upper side of a raw material sheet (2) before it is introduced into a defibrator (1). Immediately before the introduction a heating is effected. When the rectininear bi-component fibers (17) are introduced into defibrator (1), the beater bars (9) effect a curling effect to provide a raw material including curled bi-component fibers. Hereby it is possible to substantially reduce the manufacturing costs, however, having the effect of curled bi-component fibers in the final fibrous product. Moreover, a good bonding of the fibers is obtained in the final product.

8 Claims, 2 Drawing Sheets

METHOD FOR THE PRODUCTION OF FIBROUS MATERIAL CONTAINING CURLED FIBERS

BACKGROUND OF THE INVENTION

This invention relates to a method for the production of a fibrous material containing curled fibers and comprising the steps of passing a raw material sheet of cellulosic fibers into a defibrator and drawing a stream of gas containing the so-formed fibers suspended out of the defibrator. The stream of gas is intended to be passed through a forming wire to form a fibrous sheet.

The fibers to be used in the present invention comprise cellulosic fibers, wood fibers, mixtures with synthetic fibers including bicomponent fibers and synthetic fibers. The synthetic fibers may, e.g., be of polypropylene or polyethylene. Also glass fibers, rock wool fibers, and pretreated fibers may be used.

When making a fibrous sheet material containing curled fibers it is customary to add curled fibers to the cellulosic fibers. Curled fibers containing a thermoplastic resin are advantageous due to the softness and the pliability of such curled fibers and the ability to use the thermoplastic material as a binder instead of using latex binders. However, curled bi-component fibers are very expensive in comparison with ordinary cellulosic fibers. The curled fibers are also expensive in relation to rectilinear bi-component fibers. Thus the cost of curled bi-component fibers is approximately double the cost of rectilinear bi-component fibers.

When rectilinear synthetic resin-containing fibers are used, a better bonding is obtained instead of the use of a latex binding. However, there is a risk that the rectilinear synthetic fibers extend outside the product. Thus the product will appear with a poor hand and feel. Thus, it will not have a good wearing comfort as it is rough and unpleasant for the user. When curled synthetic fibers are used instead, the synthetic fibers will not extend outside the product. This is due to the fact that the curled synthetic fibers are soft and pliable. Thus, the fibers will remain inside a web formed even if the web is folded.

It is the object of the present invention to provide a method making it possible to use rectilinear bi-component fibers in the manufacture, however, having the effect of the curled bi-component fibers in the final product.

It is a further object of the invention to provide a method in which the curling of the bi-component fibers is effected simultaneously with the defibration of the raw material sheet of cellulosic fibers.

SUMMARY OF THE INVENTION

According to the present invention the above objects are obtained in a method wherein rectilinear fibers at least partly made of a thermoplastic resin are applied to the upper side of the raw material sheet, wherein at least the resin-containing rectilinear fibers are heated immediately before entering the defibrator and wherein the sheet is defibrated by beater bars having a fine saw teeth surface effecting a curling of the resin-containing fibers, the beater bars being rotated in a direction to hit the upper side of the sheet.

In the final product the thermoplastic resin of one fiber may be welded together with thermoplastic resin of other fibers. Thereby the binding or coherence of the product is improved in relation to a product only comprising latex bonds.

The synthetic fibers are preferably bi-component fibers. It is especially preferred to use fibers consisting of a core coated with a thermoplastic resin.

As the rectilinear synthetic fibers which contain thermoplastic resin are applied to the upper side of the raw material sheet these fibers will be subjected to the action of beater bars in the defibrator.

In order to obtain the synthetic fibers as curled fibers they are heated immediately before introducing them into the defibrator. Thereby the fibers can easily be given a change in shape. This new shape is maintained due to the temperature drop inside the defibrator. Thus the synthetic fibers are stabilized in their new form and simultaneously they are mixed with the cellulosic fibers. Due to the saw teeth surface of the beater bars, the fibers are curled in their new shape. The amount of resin-containing fibers is 20 to 25% by weight of the total amount of the fibers.

The method according to the invention makes it possible to use the less expensive rectilinear bi-component fibers and simultaneously have the advantages of curled bi-component fibers.

It is a further object of the invention to provide a defibrator for use in the above-mentioned method. Accordingly, a defibrator is also provided wherein each beater bar has a leading edge which is provided with saw teeth having rounded tips and arranged in the outer end portion of the beater bar.

Preferably the teeth have a height of 0.5 to 1.5 mm and a mutual distance of 1 to 1.5 mm.

When the saw teeth act on the upper side of the cellulosic raw material sheet, they will also act on the bi-component fibers. Due to the saw teeth surface of the beater bars a curling effect is obtained in the bi-component fibers.

It should be stressed that the action of the beater bars is not a cutting. The beater bars effect rather a breaking of the raw material sheet. Thus the fibers are not cut but rather separated into individual fibers. In order to make the defibration effective, the-beater bars should act on the fibers as many times as possible in order to separate possible agglomerations of fibers. Accordingly, the raw material sheet is advanced at a low speed of 0.5 m/s to 2 m/s, preferably of 1 m/s. Moreover, the defibrator may be constructed in accordance with the teachings of my U.S. Patent application Ser. No. 141,936, filed Oct. 28, 1993, now U.S. Pat. No. 5,414,902 entitled; "Defibrator Having Improved Defibration". The content thereof is hereby incorporated by reference.

Further features and advantages of the present invention will be understood by reference to the attached drawings taken in conjunction with the ensuing discussion.

DESCRIPTION OF THE PREFERRED EMBODIMENTS

Figure 1:
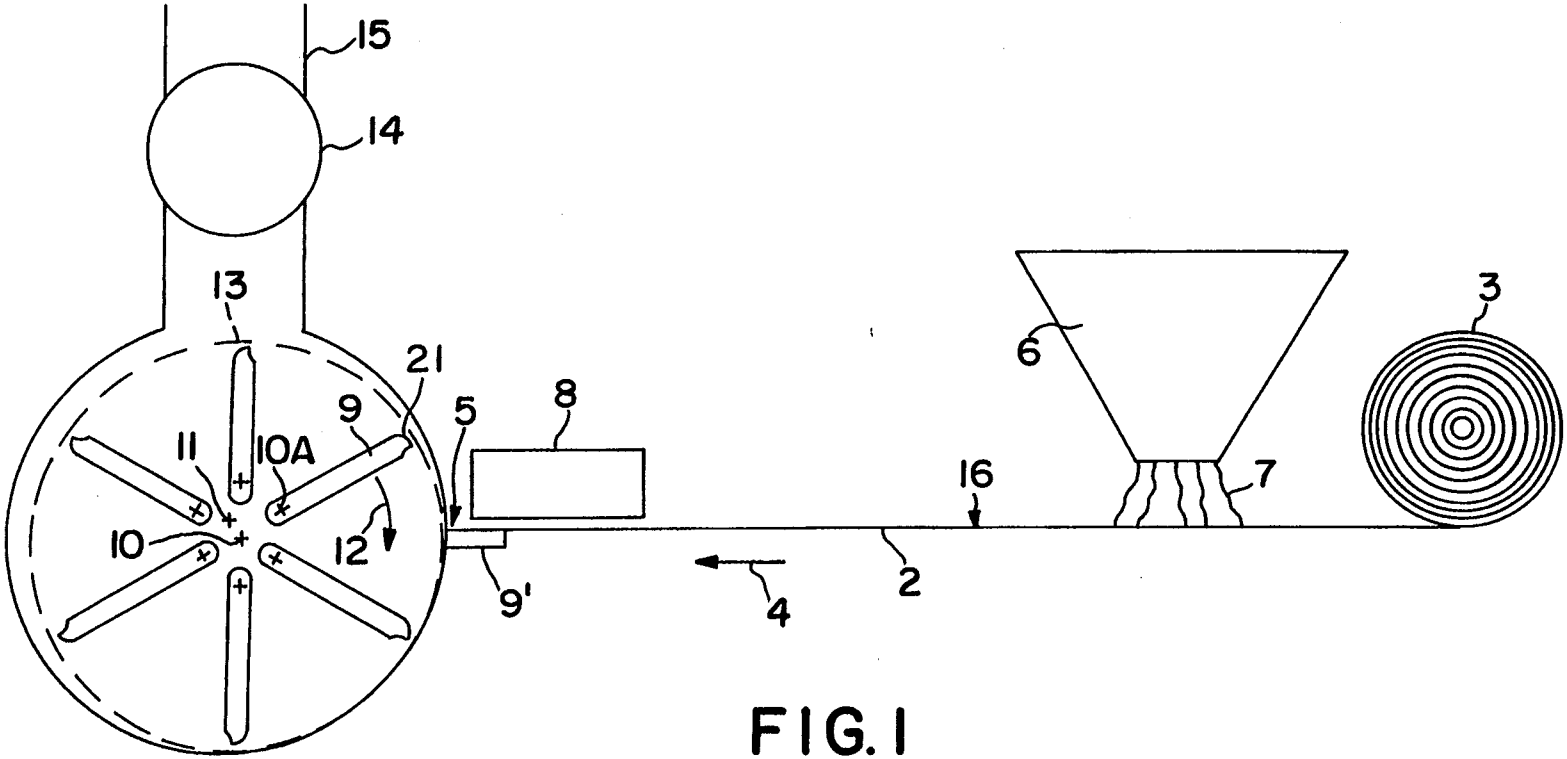
FIG. 1 illustrates diagrammatically an embodiment of a method according to the present invention.

FIG. 1 illustrates a defibrator 1, a sheet 2 of raw material of cellulosic fibers contained in a reel 3. The sheet 2 is advanced according to the direction of an arrow 4 and is introduced into the defibrator 1 through a horizontally orientated inlet opening 5. Above the sheet 2 a hopper 6 is arranged. The hopper 6 contains rectilinear bi-component fibers. A dust 7 of such fibers is applied to the upper side of the sheet 2. Immediately upstream of the defibrator 1 a heating member 8 is arranged. The heating member 8 is intended for radiant heating at least of the bi-component fibers immediately before the entrance of the defibrator 1 through the inlet opening 5.

The defibrator 1 contains a series of beater bars 9 (only one is shown) arranged in six parallel rows extending along an axis of rotation 10. Each beater bar 9 is able to swing around an axis 10A parallel with the axis of rotation 10. Alternatively, the beater bars 9 may be arranged in rows extending helically through the defibrator. The beater bars 9 cooperate with a beater plate 9'. It is preferred that the axis of rotation 10 for the beater bars 9 is offset in relation to a central axis 11 through the defibrator 1. The beater bars are rotated according to the direction of an arrow 12. An outlet 13 is arranged at the top of the defibrator 1. Accordingly, the fibers are led through 270° before being drawn out of the defibrator 1. Hereby a good defibration is ensured as the beater bars may act on the fibers several times. Such multiple beater bar action on the fibers is especially effective if the defibrator is constructed in accordance with the above-mentioned copending U.S. Patent Application.

In the outlet 13 a suction fan 14 is arranged for drawing out a stream of gas containing suspended fibers which are formed in the defibrator. A duct 15 in which the suction fan 14 is arranged would be extended (not shown) and being intended for passing the stream of gas containing the so-formed fibers through a forming wire to form a fibrous sheet. Alternatively the duct 15 is connected with distributor means for depositing the so-formed fibers on a forming wire to form a fibrous sheet.

The defibrator 1 might have a length (cross-wise direction of the sheet 2) of 250 to 1000 mm and contains six rows of beater bars 9 each having a width of 5 mm. The diameter of the defibrator 1 is of 600 to 800 mm and the length of each beater bar is of 180 to 400 mm, preferably 180 to 200 mm. Moreover, the defibrator 1 might be connected with an inlet for cooled gas (not shown). This would enable an especially marked temperature drop in the fibers which have been heated by the heating member 8 immediately before the entrance into the defibrator. Hereby a stable curled configuration of the fibers is obtained.

Before explaining the method illustrated in FIG. 1 the beater bar is explained with reference to FIG. 2.

Figure 2:
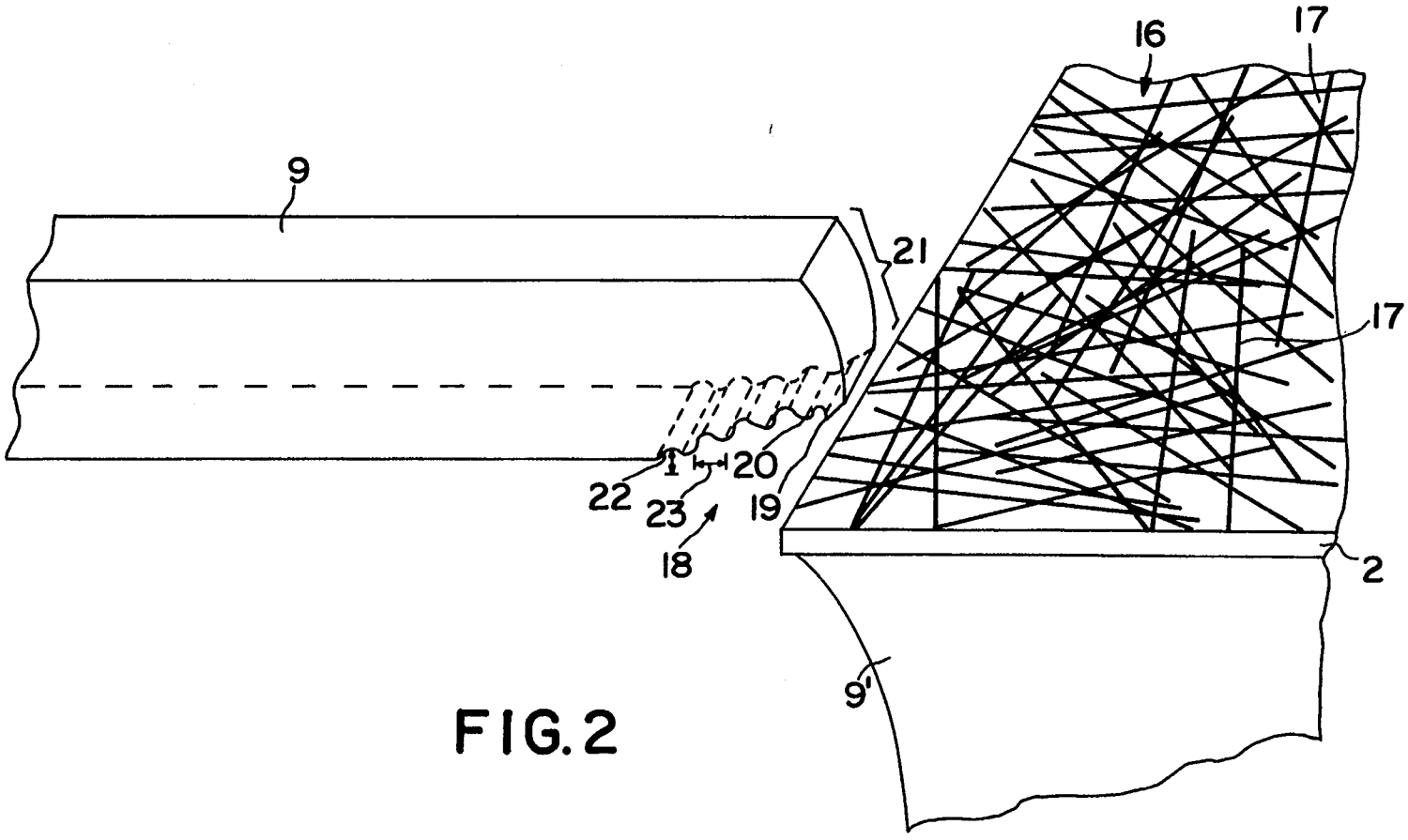
FIG. 2 illustrates a diagrammatically enlarged perspective view of a beater bar for use in a defibrator according to the invention.

FIG. 2 illustrates an enlarged perspective view of a single beater bar 9. At the inlet opening 5 the beater plate 9' supports the sheet 2 which has a cross-wise extension corresponding to the length of the defibrator.

The leading edge of the beater bar 9 is provided with a number of cross-wise extending saw teeth 19 having rounded tips 20. The saw teeth 19 are only arranged at the outer end portion 21 of the beater bar 9. The saw teeth 19 have a height 22 of 0.5 to 1.5 mm and a mutual distance 23 of 1 to 1.5 mm.

The method according to the present invention will now be described. At the upper side 16 of the sheet 2 the dust 7 of bi-component fibers is deposited. The rectilinear fibers 17 will have lengths of 6 to 10 mm and a diameter of 0.1 to 0.4 mm and are supplied in an amount of 20 to 25% by weight of the total amount of fibers. The fibers 17 are cellulosic fibers which are coated with a thermoplastic resin.

When the sheet 2 is advanced towards the defibrator 1 it passes immediately below the heating member 8. Hereby the bi-component fibers 17 are heated so that the thermoplastic resin is raised to a level above the plastification temperature. The heated fibers are introduced into the defibrator 1 lying at the upper side 16 of the sheet 2. The heated bi-component fibers 17 are subjected to the action of the saw teeth 19 of the beater bars 9. Hereby the fibers 17 undergo a curling. Due to the temperature drop the bi-component fibers 17 will remain in their curled state. In order to ensure the temperature drop it is preferred to lead a cooled gas into the defibrator 1.

The bi-component fibers 17 are mixed with the cellulosic fibers of the sheet 2. Hereby a fibrous material is obtained which may be used to form a fibrous sheet in which bonding is ensured partly or totally by the curled bi-component fibers.

The method is advantageous in that the binding effect of curled bicomponent fibers may be obtained in the final sheet product, however, using a raw material in form of rectilinear bi-component fibers which are less expensive.

It is not explained in detail how the fibrous material is deposited on a forming wire and used for the manufacture of a fibrous sheet. These steps will be within common knowledge for a skilled in the art, seeing that such steps will be identical with the manufacturing steps effected when admixing more expensive curled fibers into the cellulosic fibers before depositing the fiber-mixture on the forming wire.

I claim:

1. A method for the production of a fibrous material containing curled fibers which comprises the steps of providing a raw material sheet of cellulosic fibers, applying rectilinear thermoplastic resin-containing fibers to an upper side of said raw material sheet, heating said thermoplastic resin-containing fibers on said raw material sheet, passing said raw material sheet with heated thermoplastic resin-containing fibers thereon into a defibrator containing beater bars with fine saw teeth surfaces at their leading edges, contacting said upper side of said raw material sheet with the leading edges of said fine saw teeth surfaces so as to defibrate said raw material sheet and curl said thermoplastic resin-containing fibers, and passing gas into said defibrator to provide an exit stream of gas containing suspended cellulosic and thermoplastic resin-containing fibers.

2. A method as defined in claim 1, wherein said thermoplastic resin-containing fibers comprise cellulosic fibers coated with a thermoplastic resin.

3. A method as defined in claim 1, wherein the amount of thermoplastic resin-containing fibers is 20 to 25% by weight of the total amount of fibers suspended in said stream of gas.

4. A method as defined in claim 1, wherein the raw material sheet is introduced substantially horizontal into the defibrator and wherein said cellulosic and thermoplastic resin-containing fibers are led at least through 270° before being drawn out of the defibrator in said gas stream.

5. A method as defined in claim 1, wherein the thermoplastic resin-containing fibers have a length of 6 to 10 mm and a diameter of 0.1 to 0.4 mm.

6. A method as defined in claim 1, wherein said heating step comprises applying radiant heat to said thermoplastic resin-containing fibers.

7. A method as defined in claim 1, wherein said gas passed into the defibrator is cooled gas.

8. A method as defined in claim 1, wherein the raw material sheet is passed into the defibrator at a speed of 0.5 m/s to 2 m/s.

* * * * *